US007797903B2

(12) United States Patent
Lehane, Jr.

(10) Patent No.: US 7,797,903 B2
(45) Date of Patent: Sep. 21, 2010

(54) COMPRESSED DOVETAIL LANCE

(75) Inventor: James J. Lehane, Jr., McHenry, IL (US)

(73) Assignee: USG Interiors, Inc., Chicago, IL (US)

( * ) Notice: Subject to any disclaimer, the term of this patent is extended or adjusted under 35 U.S.C. 154(b) by 1339 days.

(21) Appl. No.: 11/283,620

(22) Filed: Nov. 21, 2005

(65) Prior Publication Data

US 2007/0113507 A1 May 24, 2007

(51) Int. Cl.
*E04B 2/00* (2006.01)
*E04B 5/00* (2006.01)
*E04B 9/00* (2006.01)

(52) U.S. Cl. ..... 52/506.07

(58) Field of Classification Search ..... 52/506.07; 29/897.312, 897.35
See application file for complete search history.

(56) References Cited

U.S. PATENT DOCUMENTS

| | | | | | |
|---|---|---|---|---|---|
| 2,979,806 | A * | 4/1961 | Macomber | 29/897.35 |
| 3,420,032 | A * | 1/1969 | Felt | 52/844 |
| 4,489,529 | A * | 12/1984 | Ollinger et al. | 52/506.07 |
| 5,442,885 | A * | 8/1995 | Laven et al. | 52/844 |
| 5,839,246 | A * | 11/1998 | Ziegler et al. | 52/506.07 |
| 5,979,055 | A * | 11/1999 | Sauer et al. | 29/897.35 |
| 6,047,511 | A * | 4/2000 | Lehane et al. | 52/506.07 |
| 6,351,919 | B1 * | 3/2002 | Lin et al. | 52/506.07 |
| 6,446,407 | B1 * | 9/2002 | Lehane et al. | 52/506.07 |
| 6,722,098 | B2 * | 4/2004 | Platt | 52/506.05 |
| 6,748,713 | B2 * | 6/2004 | See | 52/506.07 |
| 6,751,922 | B1 * | 6/2004 | Auriemma | 52/506.05 |
| 7,240,460 | B2 * | 7/2007 | Platt | 52/506.07 |
| 7,278,243 | B2 * | 10/2007 | Jones et al. | 52/506.07 |
| 7,516,585 | B2 * | 4/2009 | Lehane et al. | 52/506.07 |
| 2003/0154686 | A1 * | 8/2003 | Platt | 52/733.1 |
| 2006/0010812 | A1 * | 1/2006 | Jones et al. | 52/506.07 |
| 2007/0028554 | A1 * | 2/2007 | Ferrell et al. | 52/731.7 |
| 2007/0113507 | A1 * | 5/2007 | Lehane, Jr. | 52/506.07 |
| 2007/0125038 | A1 * | 6/2007 | Lehane et al. | 52/733.1 |
| 2008/0134611 | A1 * | 6/2008 | Lehane et al. | 52/506.07 |
| 2008/0155927 | A1 * | 7/2008 | Wendt et al. | 52/506.07 |
| 2008/0229680 | A1 * | 9/2008 | Jahn et al. | 52/105 |
| 2008/0245018 | A1 * | 10/2008 | Miller et al. | 52/506.07 |
| 2009/0158684 | A1 * | 6/2009 | Lehane et al. | 52/506.07 |

* cited by examiner

*Primary Examiner*—Richard E Chilcot, Jr.
*Assistant Examiner*—Andrew J Triggs
(74) *Attorney, Agent, or Firm*—Pearne & Gordon LLP

(57) ABSTRACT

A roll formed sheet metal grid tee, having a multilayer web, is rigidified by a series of longitudinally spaced tabs lanced through the web. The tabs are cut with a dovetail shape and are foreshortened relative to the holes, made when they are formed, by bending them along a line parallel to a side of the tab that remains uncut. After being foreshortened, the tab is pressed back into its associated hole and tight locking interference is developed between the divergent dovetail sides of the tab and the hole. The tab is incompletely pushed back into the hole so that the layers of the tab are misaligned with corresponding respective layers of the web to assure that the tabs prevent relative shear-like movement and/or spreading of the web layers.

11 Claims, 3 Drawing Sheets

FIG. 8
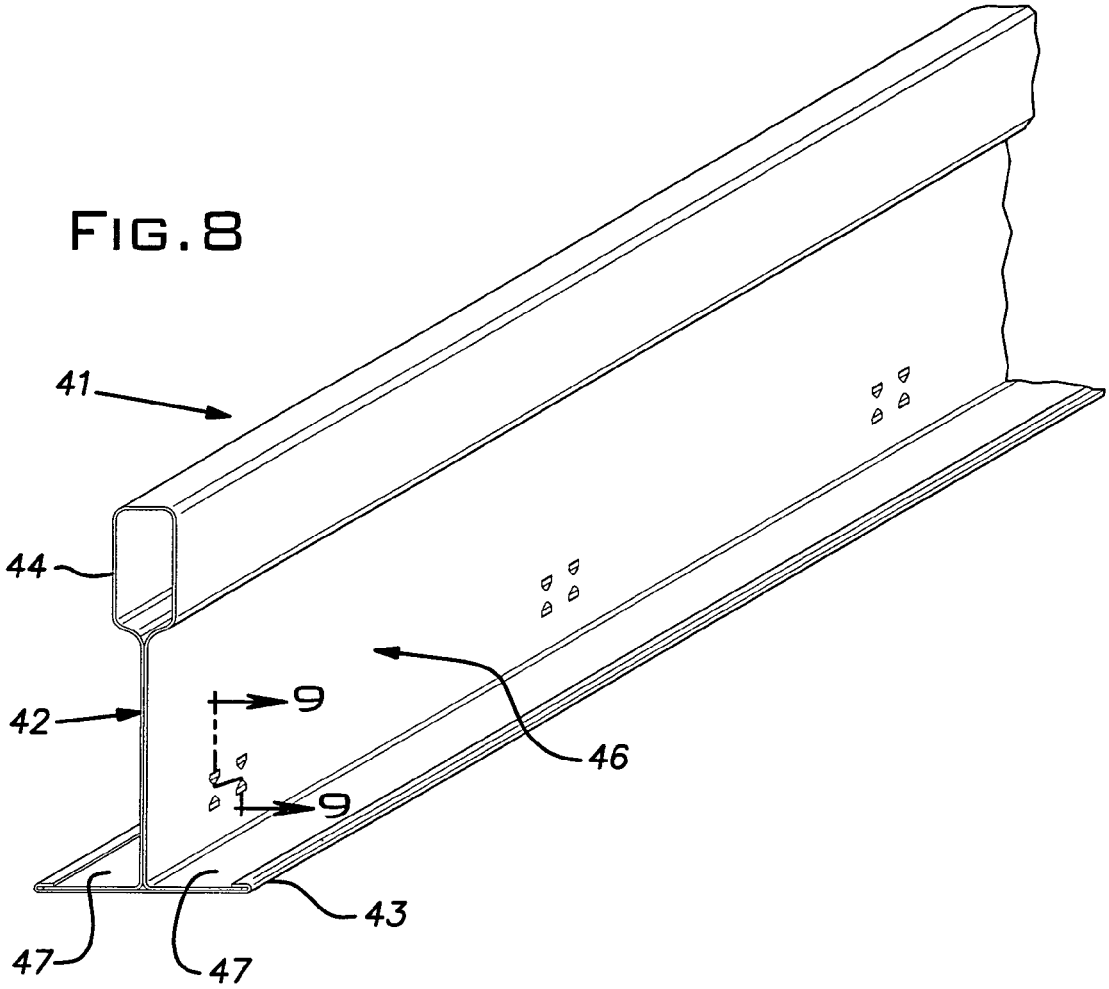
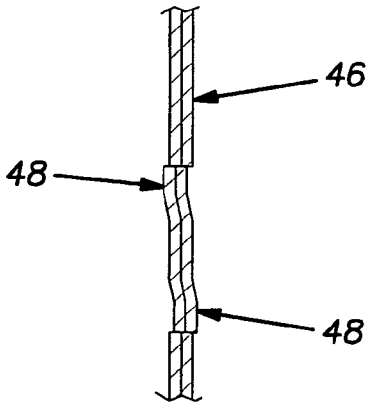
FIG. 9

COMPRESSED DOVETAIL LANCE

BACKGROUND OF THE INVENTION

The invention relates to improvements in suspended ceiling grid members and, in particular, to features for improving the structural integrity and performance of such members.

PRIOR ART

Grid members for suspended ceilings are typically made from steel strip stock roll formed most commonly into a T-shape that, in use, is inverted. Roll formed sheet metal tees customarily have the vertical portion of their cross-sections made of multiple layers of sheet stock. It is known from U.S. Pat. Nos. 4,489,529, 5,979,055, 6,047,511, and 6,446,407, for example, to secure the double layers of a grid tee together by deforming spaced local areas of the web into stitches for holding the layers in abutting contact. The latter patents disclose the formation of stitches in a strip rolling process.

SUMMARY OF THE INVENTION

The invention involves the lancing of multiple layers of a web in a roll formed sheet metal grid runner to create formations that prevent relative movement between the layers and thereby improve the performance of the grid runner. The disclosed lanced formations can be effectively used to improve the torsional rigidity of a grid runner by locating the formations distal from a neutral torsional axis of the runner. Additionally, the lanced formations can serve to maintain the web layers in abutting contact and thereby ensure that the visual appearance of certain types of grid runners remain uniform.

In the disclosed embodiments, the lance is in the form of a tab with an angular profile having one side remaining attached to the main body area of the web and the other sides at least partially cut from the main body of the web and at obtuse angles relative to the attached side. The lanced tab is formed with a bend parallel to the attached side to foreshorten the tab relative to the plane of the web and the opening in the web from which it is cut. This foreshortening of the tab in combination with the obtuse angles of its sides assures that a tight fit between its edges and the edges of the hole is created. The tab is preferably bent so that the tab edge of one web layer abuts the hole edge of another web layer and thereby locks the layers together in particular against relative sliding movement between the layers. By resisting relative sliding motion between the layers, the lanced tabs, when properly located on the web, can give the grid tee relatively high torsional rigidity.

BRIEF DESCRIPTION OF THE DRAWINGS

FIG. 8 is a fragmentary perspective view of a second embodiment of a grid tee embodying the invention; and FIG. 9 is a fragmentary cross-sectional view of a lanced tab area of the tee taken in the plane 9-9 indicated in FIG. 8.

DESCRIPTION OF THE PREFERRED EMBODIMENTS

Figure 1:
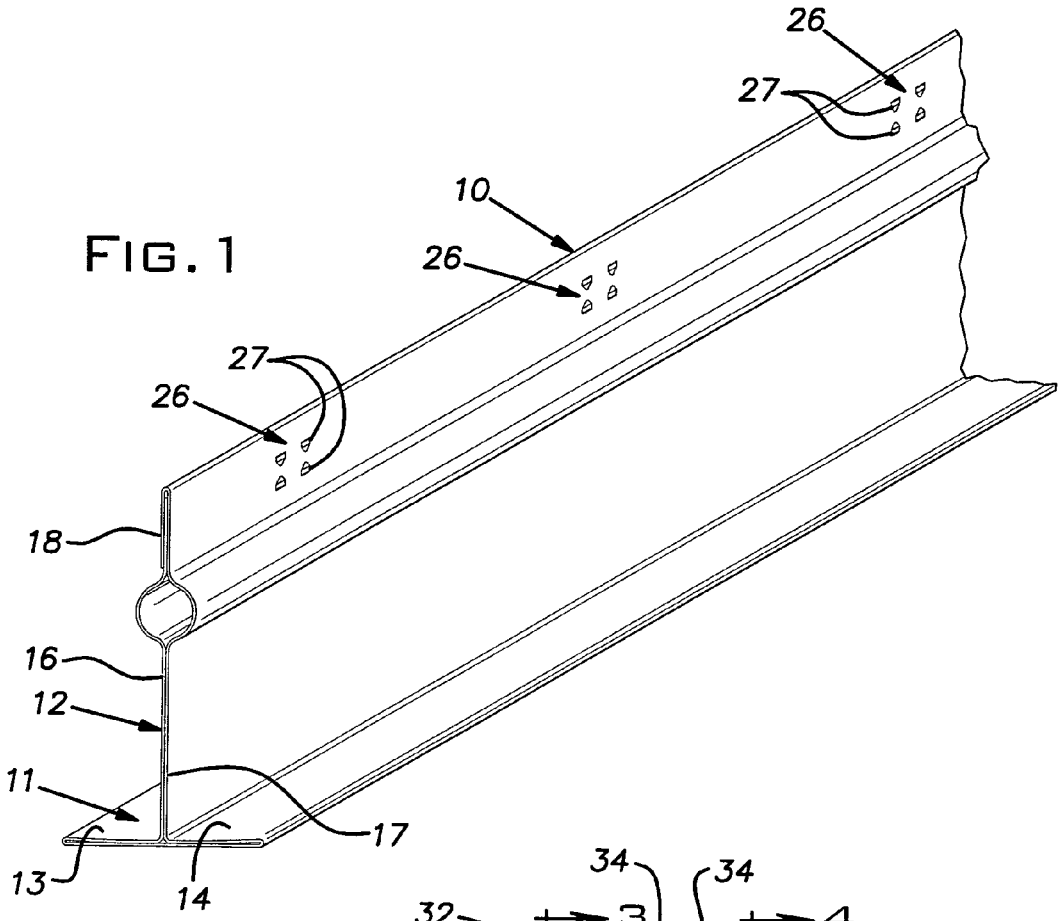
FIG. 1 is a fragmentary perspective view of a grid tee embodying the invention.

Referring now to the drawings, and in particular to FIG. 1, there is shown a form of a grid runner 10 in the general shape of an inverted tee. The grid runner or tee 10 includes a lower horizontal flange 11 and a vertical web 12. The body of the tee is preferably formed as a single strip of mild steel sheet roll formed into the illustrated profile. The sheet stock is folded on itself at each lateral side or section 13 of the flange 11 so that these flange sections are double layers. Similarly, the web 12 is a structure of double layers 16, 17 apart from where its upper region includes a third layer 18. These three layers 16-18 exist between an upper edge 19 of one of the two main layers 16 and a downwardly facing edge 21 of the third or minor layer 18. The third layer 18 is an integral extension of one of the double or main layers 17 and is folded downwardly over the upper edge 19 of the other major layer 16. As seen in FIG. 1, for example, the layers 17, 18 sandwich and laterally trap the other layer 16. The web 12 includes a reinforcing bulb 22 formed of opposed integral ribs rolled in the respective layers 16, 17.

Figure 2:
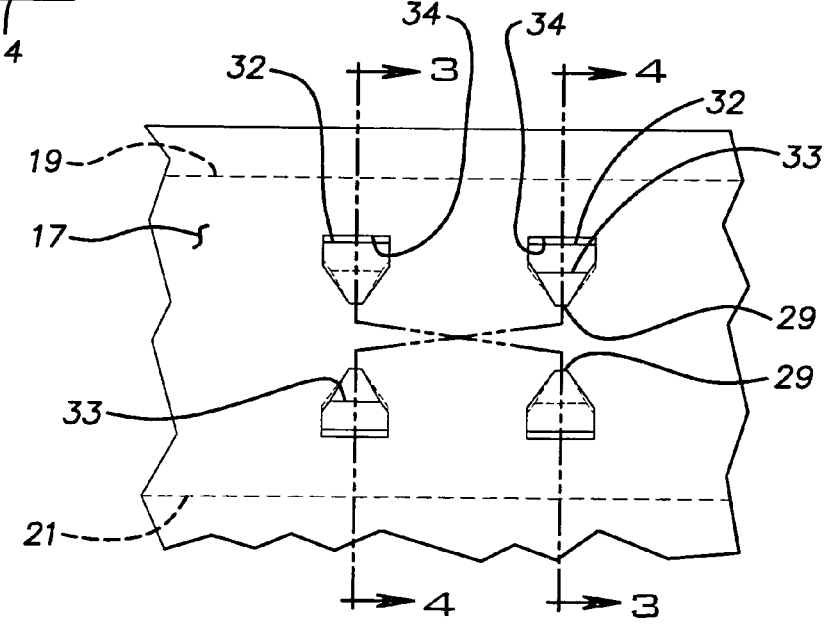
FIG. 2 is an enlarged fragmentary view of an area of the web of the tee of FIG. 1 after being lanced.

The web 12 is lanced above the bulb 22 at locations 26 spaced along the length of the runner 10. In the illustrated example, the lance 27 is arranged in groups of four at each location 26. The lances, designated 27, of a group are identical except for orientation; a pair of the lances 27 (at the left in FIG. 2) are displaced into the space below the plane of the drawing and the other pair of lances (at the right in FIG. 2) are disposed into the space above the plane of the drawing. Each lance or tab 27 of a pair is oriented 180°, in a vertical sense, from the other tab.

Each lance or tab 27 is partially cut through each of the layers 16-18. The tab 27 when viewed in a plane parallel to the web 12 preferably has a polygonal profile and at least one side 28 that lies at an obtuse angle with a side 29 that remains uncut. The illustrated tabs 27 are shaped like a dovetail having two opposed sides 28 that are cut at obtuse angles with respect to the uncut side 29. The tab 27 includes a fully cut side 32 extending between the obtuse sides 28 that, in the illustrated case, is parallel to the uncut side 29.

The tabs 27 are formed in two operations. In the first operation, the far edge or side 32 remote from the uncut side 29 and portions of the obtuse edges or sides 28 remote from the uncut side are sheared from the three web layers 16-18. At the same time, the tool shears the tab from the main areas of the web layers, it operates to form the tab material by bending it along a line 33 parallel to the sides 29, 32. The bend 33 requires the tab material on the side of the bend remote from the uncut side 29 to be drawn or to flow towards the bend. The tab 27 is thus foreshortened when viewed in a plane parallel to the plane of the web 12.

Figure 5:
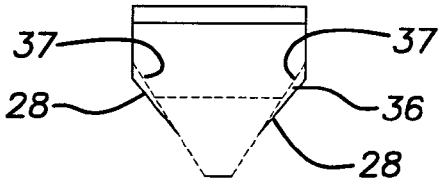
FIG. 5 is a somewhat schematic enlarged view of one of the lanced tabs of FIG. 2.

FIG. 5 is a diagrammatic illustration of this foreshortening effect where the cut edge or side 32 is displaced vertically from its corresponding edge 34 on the body of the web 12. The theoretical area 36 lying between the obtuse tab edges 28 and corresponding web hole edges 37 is a measure of the tight interference that can be obtained with the disclosed technique of forming the tab 27 to foreshorten it.

Figure 3:
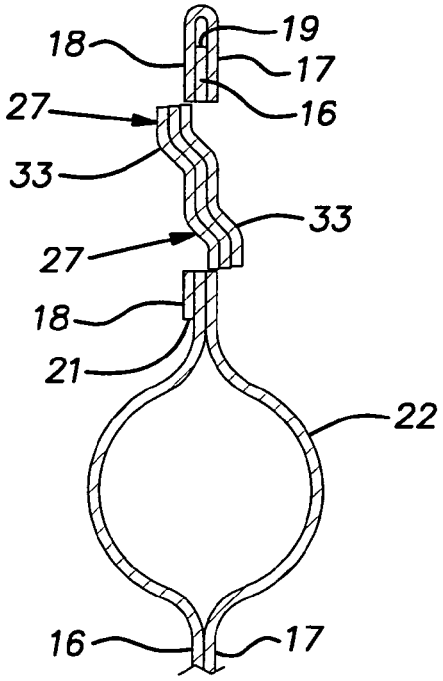
FIG. 3 is a cross-sectional view of grid tee lanced tabs in an intermediate formed condition taken in the staggered plane 3-3 in FIG. 2.
Figure 4:
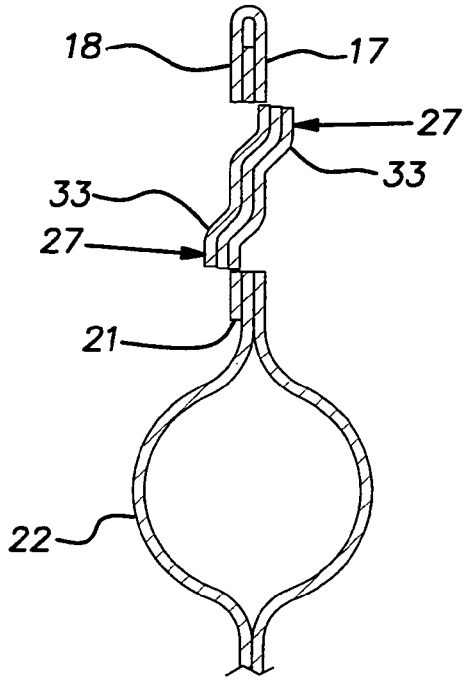
FIG. 4 is a cross-sectional view of other grid tee lanced tabs in an intermediate formed condition taken in the staggered plane 4-4 as indicated in FIG. 2.
Figure 6:
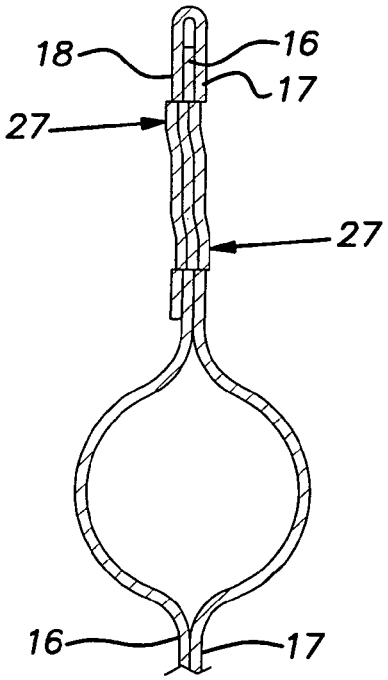
FIGS. 6 and 7 are views similar to FIGS. 3 and 4, respectively, illustrating the lanced tabs in their final configuration pressed back towards the plane of the web.
Figure 7:
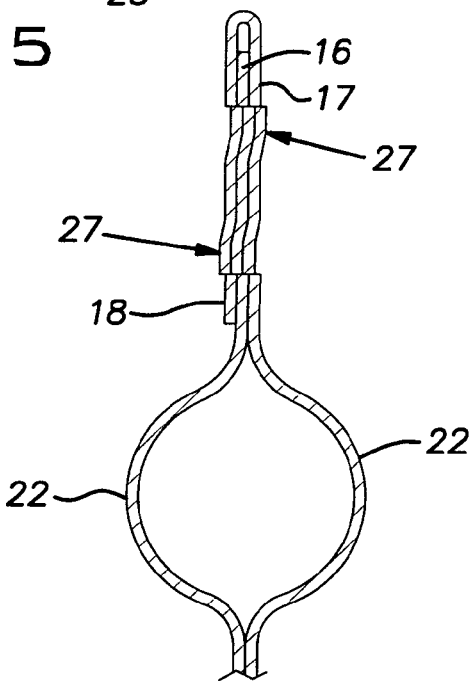

The second operation on the lances or tabs 27 involves pressing them back from the condition illustrated in FIGS. 3 and 4 towards the plane of the web 12. The tabs 27 can be returned through a distance of about 75 to 80% of the distance they are originally displaced from the plane of the web. Preferably, the tabs 27 are bent back so that as depicted in FIGS. 6 and 7, the tab layers are misaligned relative to the layers of the web. In particular, the tabs 27 are pushed back so that the middle layer of a tab straddles the middle layer 16 and one of the outer layers 17 or 18 of the web 12. With reference to FIG. 6, in the lanced region the upper part of outer layer 18 and the lower part of outer layer 17 cannot move longitudinally relative to the middle layer 16 because they are trapped by the inner layer of the tabs 27. With reference to FIG. 7, in the lanced region, the lower part of the outer layer 18 and the upper part of the outer layer 17 cannot move longitudinally because they are trapped by the inner layer of the tab 27. The central layer of each tab 27 is reinforced and stabilized by the other two layers helping it to resist lateral deflection out of its final formed position straddling one or the other outer layers 17 or 18 of the web 12 at the opening formed by the respective tab.

The section views of FIGS. 3, 4 and 6, 7 are taken in vertical planes for clarity. It will be understood that the above discussion of the offset and straddling by the middle tab layer of the middle web layer 16 and one or the other outer web layers 17 or 18 is applicable at the interface between the tab edges or sides 28 and the edges of the opening corresponding to these tab edges.

It will be noted that a single one of the lances or tabs 27 is capable of locking the several layers together when formed according to the invention in the described manner. The disclosed arrangement of four tabs affords a high level of redundancy in gripping action to assure reliable interlocking of the layers 16-18.

When an elongated body made of folded or rolled sheet such as the grid runner 10 is subjected to torsion about its longitudinal axis, the layers of the body tend to shift longitudinally relative to one another. When the lances or tabs 27 are used to improve the torsional stiffness of a tee, it is desirable that the tab edges 28 are oriented at acute angles of between, for example, 0 and 45°, to a line perpendicular to the longitudinal direction of the grid runner. This orientation assures that the reaction forces between the tab and opening from which it is cut when a torque is applied to the grid runner work to resist relative longitudinal slippage between the layers. The position of the lanced tabs 27 near the upper extremity of the web 12 and therefore remote from a neutral torsional axis of the grid member enables the tabs 27 to more effectively resist twisting of the grid member.

FIG. 8 illustrates another embodiment of the invention applied to a grid runner or tee 41. The grid runner 41, in a generally conventional manner, includes a main body 42 and a cap strip 43. The main body 42 is roll formed from a single sheet metal strip and includes a hollow bulb 44, a double wall or layer web 46 and single layer flange portions 47. The flange portions 47 are covered with the cap strip 43 which is folded over the outer edges of the flange portions 47 by a rolling process. The double layer web 46 is provided with lanced tabs 48 configured and grouped as described above in reference to the grid runner 10. The tabs 48 differ from the tabs 27 in that they comprise only two layers of sheet metal as shown in FIG. 9 but retain the dovetail profile so as to include an edge on each of its opposite sides at obtuse angles to the attached side. FIG. 9 illustrates cross-sections of two typical lanced tabs 48. As seen there, the tabs 48, after being formed, are pushed back towards the plane of the web 46 so that one layer of each of the tabs is mechanically locked in a position where it straddles the two layers of the web. The lanced tabs 48 are preferably located near the flange portions 47 so that they are as far as practical, spaced from a neutral torsional axis to obtain greater effectiveness in resisting twisting about the longitudinal axis of the tee. Besides serving to torsionally stiffen a grid tee, the tabs can be useful in preventing the web layers from spreading apart which function can be especially important in certain special grid tee configurations such as disclosed in U.S. Pat. No. 4,535,580, for example. It will be understood that the tabs can be formed in a stamping press when other stamping operations are being performed on the grid tee.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A suspended ceiling grid tee, the tee having a vertical generally planar web portion formed of multiple layers of a single metal strip, the web portion being lanced through the multiple layers to form a tab at a plurality of locations along its length, the tab having an uncut anchored side and diverging cut sides that diverge from said uncut side, at least one of the cut sides forming an obtuse angle with the uncut side, a cut side generally opposed to the anchored side bridging the diverging sides, the tab being bent between the anchored side and the opposed side whereby it is foreshortened with reference to a plane parallel to the plane of the web portion, each of the layers of the tab being first displaced from the plane of its respective layer of the web portion and thereafter being pressed back towards the plane of its respective layer of the web portion whereby the obtuse edge of the tab is put in tight engagement with the corresponding edge of the web portion because of the foreshortening of the tab produced by the bend.

2. A grid tee as set forth in claim 1, wherein the oblique sides of said tab are generally transverse to the longitudinal direction of the grid tee.

3. A grid tee as set forth in claim 1, wherein the tab is formed in groups at said spaced locations.

4. A grid tee as set forth in claim 3, wherein said groups of tabs include pairs of tabs that extend from the uncut side in opposite directions.

5. A grid tee as set forth in claim 4, wherein said opposite directions are transverse to the longitudinal direction of the grid tee.

6. A grid tee as set forth in claim 3, wherein groups of tabs include sets that are initially pressed from opposite sides of the web portion.

7. A grid tee as set forth in claim 1, wherein said web portion includes three layers.

8. A grid tee as set forth in claim 1, wherein said tabs are pressed back towards the original plane of the web portion in a manner whereby the layers of the tabs straddle the original layers of the web portion from which they are cut and the adjacent layers.

9. A grid tee as set forth in claim 1, wherein a strip of metal forming the grid tee is folded into a shape where the strip is reversed on itself adjacent one vertical extremity of the web and the tabs are located at an opposite vertical extremity of the web.

10. A grid tee as set forth in claim 1, wherein a set of tabs are displaced from one side of the web portion and another set of the tabs are displaced from an opposite side of the web portion.

11. A method of improving the resistance of a roll formed sheet metal grid tee with a multi-layer web to deformation comprising lancing the web to form a plurality of longitudinally spaced tabs, the tabs remaining uncut at one side, cut at a pair of sides extending away from the uncut side and diverging from one another in the direction away from the uncut side, and cut at a fully cut side bridging the two diverging sides, at least one of the diverging sides being cut at an angle that is obtuse to the uncut side, bending the tab out of the plane of the web, bending the tab parallel to the uncut side to foreshorten the tab relative to the hole from which it is cut, and pressing the tab back towards the plane to tighten the obtuse edge of the tab against the corresponding edge of the hole from which the tab is cut whereby the layers of the web are tightly locked together.

* * * * *